US011777192B2

(12) United States Patent
Kim et al.

(10) Patent No.: US 11,777,192 B2
(45) Date of Patent: Oct. 3, 2023

(54) ANTENNA PACKAGE AND IMAGE DISPLAY DEVICE INCLUDING THE SAME

(71) Applicant: DONGWOO FINE-CHEM CO., LTD., Jeollabuk-do (KR)

(72) Inventors: Na Yeon Kim, Seoul (KR); Young Ju Kim, Gyeonggi-do (KR); Won Hee Lee, Incheon (KR)

(73) Assignee: DONGWOO FINE-CHEM CO., LTD., Jeollabuk-Do (KR)

( * ) Notice: Subject to any disclaimer, the term of this patent is extended or adjusted under 35 U.S.C. 154(b) by 49 days.

(21) Appl. No.: 17/525,016

(22) Filed: Nov. 12, 2021

(65) Prior Publication Data

US 2022/0158328 A1 May 19, 2022

(30) Foreign Application Priority Data

Nov. 18, 2020 (KR) ..... 10-2020-0154537

(51) Int. Cl.

| | |
|---|---|
| ***H01Q 1/22*** | (2006.01) |
| ***H01Q 1/48*** | (2006.01) |
| ***H01Q 9/04*** | (2006.01) |
| ***H01Q 21/08*** | (2006.01) |

(52) U.S. Cl.

CPC ..... *H01Q 1/2283* (2013.01); *H01Q 1/48* (2013.01); *H01Q 9/0407* (2013.01); *H01Q 21/08* (2013.01)

(58) Field of Classification Search

CPC ..... H01Q 1/2283; H01Q 1/48; H01Q 9/0407; H01Q 21/08; H01Q 1/38; H01Q 5/22; H01Q 21/0006; H01Q 1/22; H01Q 1/241; H01Q 1/50; H01Q 1/52

USPC ..... 343/848

See application file for complete search history.

(56) References Cited

U.S. PATENT DOCUMENTS

| | | | | |
|---|---|---|---|---|
| 8,851,390 | B2 * | 10/2014 | Ikemoto | G06K 7/10336 235/492 |
| 10,305,189 | B2 * | 5/2019 | Ueda | H01Q 9/0407 |
| 10,827,607 | B2 * | 11/2020 | Park | H05K 1/0278 |
| 11,024,955 | B2 * | 6/2021 | Onaka | H01P 3/08 |
| 2013/0112754 | A1 | 5/2013 | Ikemoto | |
| 2021/0167506 | A1 * | 6/2021 | Sudo | H01Q 3/26 |

(Continued)

FOREIGN PATENT DOCUMENTS

| | | |
|---|---|---|
| KR | 10-2013-0095451 A | 8/2013 |
| KR | 10-2019-0105813 A | 9/2019 |
| KR | 10-2020-0112793 A | 10/2020 |

*Primary Examiner* — Dimary S Lopez Cruz
*Assistant Examiner* — Brandon Sean Woods
(74) *Attorney, Agent, or Firm* — The PL Law Group, PLLC

(57) ABSTRACT

An antenna package according to an embodiment of the present disclosure includes an antenna device including an antenna unit, and a flexible circuit board electrically connected to the antenna unit. The flexible circuit board has a bending area. The flexible circuit board includes a core layer having a first surface and a second surface facing each other, a signal wiring disposed on the first surface of the core layer and electrically connected to the antenna unit, a ground line disposed on the first surface of the core layer to be spaced apart from the signal wiring, a ground layer disposed on the second surface of the core layer, and a via structure penetrating a portion of the core layer in a region excluding the bending area and connecting the ground line and the ground layer with each other.

12 Claims, 5 Drawing Sheets

(56) References Cited

U.S. PATENT DOCUMENTS

| | | | | |
|---|---|---|---|---|
| 2021/0242569 | A1* | 8/2021 | Fujii | H05K 3/361 |
| 2023/0187837 | A1* | 6/2023 | Sakaida | H01Q 9/0407 343/846 |

* cited by examiner

ANTENNA PACKAGE AND IMAGE DISPLAY DEVICE INCLUDING THE SAME

CROSS-REFERENCE TO RELATED APPLICATION AND CLAIM OF PRIORITY

This application claims priority to Korean Patent Application No. 10-2020-0154537 filed on Nov. 18, 2020 in the Korean Intellectual Property Office (KIPO), the entire disclosures of which are incorporated by reference herein.

BACKGROUND

1. Field

The present invention relates to an antenna package and an image display device including the same. More particularly, the present invention relates to an antenna package including an antenna device and a circuit board and an image display device including the same.

2. Description of the Related Art

As information technologies have been developed, a wireless communication technology such as Wi-Fi, Bluetooth, etc., is combined with an image display device in, e.g., a smartphone form. In this case, an antenna may be combined with the image display device to provide a communication function.

According to developments of a mobile communication technology, an antenna capable of implementing, e.g., high frequency or ultra-high frequency band communication is needed in the display device.

A circuit board for power feeding and control signal transmission may be connected to the antenna to control a radiation driving of the antenna. However, if a driving frequency of the antenna increases, a signal loss may be increased, and as a length of a transmission path through the circuit board increases, a degree of the signal loss may be further increased.

The circuit board may be bent to be connected to, e.g., a driving integrated circuit chip. In this case, a circuit wiring may be damaged, and a bonding failure with the antenna may occur due to a bending stress Further, as a thickness of an image display device to which the antenna is employed decreases recently, a degree of a bending curvature of the circuit board may also increase. In this case, the above-described defects due to the bending may be further aggravated. Accordingly, a construction of an antenna package for obtaining reliability of electrical connection while maintaining or improving radiation properties of the antenna may be needed.

For example, Korean Published Publication No. 2013-0095451 discloses an antenna integrated into a display panel, but does not suggest the efficient circuit connection as described above.

SUMMARY

According to an aspect of the present invention, there is provided an antenna package having improved mechanical reliability and signaling efficiency.

According to an aspect of the present invention, there is provided an image display device including an antenna package with improved electrical reliability and radiation efficiency.

(1) An antenna package, including: an antenna device including an antenna unit; and a flexible circuit board electrically connected to the antenna unit, the flexible circuit board having a bending area, wherein the flexible circuit board includes: a core layer having a first surface and a second surface facing each other; a signal wiring disposed on the first surface of the core layer and electrically connected to the antenna unit; a ground line disposed on the first surface of the core layer to be spaced apart from the signal wiring; a ground layer disposed on the second surface of the core layer; and a via structure penetrating a portion of the core layer in a region excluding the bending area and connecting the ground line and the ground layer with each other.

(2) The antenna package of the above (1), wherein the flexible circuit board further includes a first area located at one end portion of the bending area and electrically connected to the antenna unit, and a second area located at the other end portion of the bending area, and the via structure includes a first via structure penetrating a portion of the core layer in the first area and a second via structure penetrating a portion of the core layer in the second area.

(3) The antenna package of the above (2), wherein the ground line includes a first ground pattern formed on the portion of the core layer in the first area and a second ground pattern formed on the portion of the core layer in the second area, and the first ground pattern and the second ground pattern are spaced apart from each other with the bending area interposed therebetween.

(4) The antenna package of the above (3), wherein the first via structure connects the first ground pattern and the ground layer with each other, and the second via structure connects the second ground pattern and the ground layer with each other.

(5) The antenna package of the above (2), wherein the ground line extends continuously throughout the first area, the bending area and the second area.

(6) The antenna package of the above (2), further including an antenna driving integrated circuit chip connected to the flexible circuit board through a portion of the signal wiring in the second area.

(7) The antenna package of the above (2), wherein a thickness of a portion of the signal wiring portion in the bending area is smaller than a thickness of a portion of the signal wiring in the first area or the second area.

(8) The antenna package of the above (1), wherein the signal wiring and the ground line are alternately and repeatedly arranged on the first surface of the core layer to be parallel with each other.

(9) The antenna package of the above (8), wherein the via structure is repeatedly arranged along an extension direction of the ground line to form a plurality of via columns.

(10) The antenna package of the above (9), wherein a pair of via columns of the plurality of via columns are spaced apart from each other with the signal line interposed therebetween.

(11) The antenna package of the above (8), wherein the antenna unit includes a radiator, a transmission line extending from the radiator and a signal pad formed at an end portion of the transmission line, and a plurality of the antenna unit is arranged in a width direction.

(12) The antenna package of the above (11), wherein the signal wiring is electrically connected to the signal pad included in each of the plurality of the antenna unit.

(13) The antenna package of the above (12), wherein the antenna unit further includes a ground pad disposed around the signal pad and separated from the signal pad and the transmission line, and the ground line is electrically connected to the ground pad.

(14) The antenna package of the above (1), wherein a conductive layer other than the signal wiring is not present on a portion of the first surface of the core layer in the bending area.

(15) An image display device, including: a display panel; and an antenna package according to embodiments as described above disposed on the display panel.

(16) The image display device of the above (15), further including an antenna driving integrated circuit chip disposed under the display panel, wherein the bending area of the flexible circuit board of the antenna package is bent to be electrically connected to the antenna driving integrated circuit chip.

An antenna package according to exemplary embodiments, an antenna package may include a circuit wiring formed on a bottom surface of a core layer of a flexible circuit board connected to an antenna device, a ground line adjacent to and spaced apart from the circuit wiring, a ground layer formed on a top surface of the core layer, and a via structure (a via hole) connecting the ground line and the ground layer. The ground line may be connected to the ground layer through the via structure to improve signal transmission/reception efficiency of a signal wiring and to prevent signal loss and interference.

In exemplary embodiments, the via structure may not be formed in a bending area of the flexible circuit board. Thus, signal loss and deterioration of driving stability due to cracks in the via structure while bending the flexible circuit board may be prevented. Further, an exposed area of the core layer of the flexible circuit board due to the cracks may also be prevented to improve life-span stability of the antenna package. Additionally, a thickness of the signal lines located in the bending area may be formed to be relatively thin to improve bending properties of the flexible circuit board.

In some embodiments, the ground line may not be formed in the bending area of the flexible circuit board. Accordingly, signal disturbance and signal loss due to damages to the ground line in the bending area while bending the flexible circuit board may be prevented.

DETAILED DESCRIPTION

According to exemplary embodiments of the present invention, there is provided an antenna package in which an antenna device and a flexible circuit board including a ground line are combined. According to exemplary embodiments of the present invention, there is also provided an image display device including the antenna package Hereinafter, the present invention will be described in detail with reference to the accompanying drawings. However, those skilled in the art will appreciate that such embodiments described with reference to the accompanying drawings are provided to further understand the spirit of the present invention and do not limit subject matters to be protected as disclosed in the detailed description and appended claims.

Figure 1:
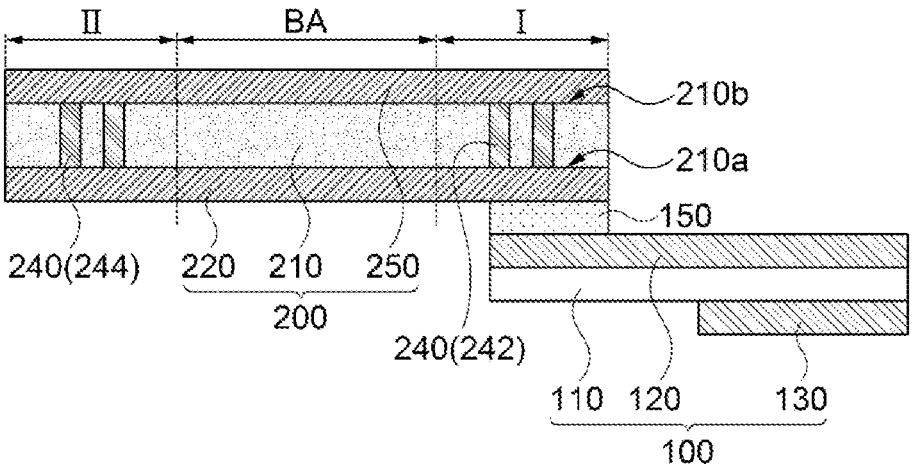
FIGS. 1 and 2 are a schematic cross-sectional view and a top planar view, respectively, illustrating an antenna package in accordance with exemplary embodiments.
Figure 2:
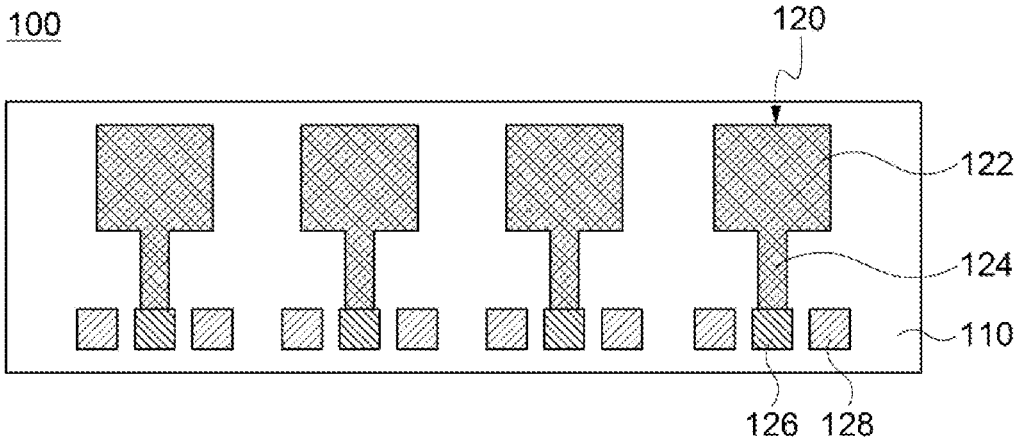

FIGS. 1 and 2 are a schematic cross-sectional view and a top planar view, respectively, illustrating an antenna package in accordance with exemplary embodiments. Specifically, FIG. 1 is a schematic cross-sectional view illustrating the antenna package. FIG. 2 is a schematic top planar view illustrating an antenna device included in the antenna package.

Referring to FIG. 1, the antenna package may include an antenna device 100 and a flexible circuit board 200 (e.g., a flexible printed circuit board (FPCB)). The flexible circuit board 200 may include a core layer 210, a signal wiring 220 formed on a surface of the core layer 210, a ground line 230 adjacent to and spaced apart from the signal wiring 220, and a ground layer 250. The signal wiring 220, the ground line 230 and/or the ground layer 250 may be formed of, e.g., a metal plating such as a copper plating.

In exemplary embodiments, the core layer 210 may include a first surface 210*a* (e.g., a bottom surface) and a second surface 210*b* (e.g., a top surface) facing each other. The signal wiring 220 and the ground line 230 may be formed on the first surface 210*a* of the core layer 210, and the ground layer 250 may be formed on the second surface 210*b* of the core layer 210.

The core layer 210 may include, e.g., a flexible resin such as a polyimide resin, a modified polyimide (MPI), an epoxy resin, polyester, a cycloolefin polymer (COP), a liquid crystal polymer (LCP), or the like. The core layer 210 may include an internal insulating layer included in the circuit board 200.

Referring to FIG. 2, the antenna device 100 may include an antenna dielectric layer 110 and an antenna unit 120 disposed on the antenna dielectric layer 110.

The antenna dielectric layer 110 may include a polyester-based resin such as polyethylene terephthalate, polyethylene isophthalate, polyethylene naphthalate and polybutylene terephthalate; a cellulose-based resin such as diacetyl cellulose and triacetyl cellulose; a polycarbonate-based resin; an acrylic resin such as polymethyl (meth)acrylate and polyethyl (meth)acrylate; a styrene-based resin such as polystyrene and an acrylonitrile-styrene copolymer; a polyolefin-based resin such as polyethylene, polypropylene, a cycloolefin or polyolefin having a norbornene structure and an ethylene-propylene copolymer; a vinyl chloride-based resin; an amide-based resin such as nylon and an aromatic polyamide; an imide-based resin; a polyethersulfone-based resin; a sulfone-based resin; a polyether ether ketone-based resin; a polyphenylene sulfide resin; a vinyl alcohol-based resin; a vinylidene chloride-based resin; a vinyl butyral-based resin; an allylate-based resin; a polyoxymethylene-based resin; an epoxy-based resin; a urethane or acrylic urethane-based resin; a silicone-based resin, etc. These may be used alone or in a combination of two or more therefrom.

In some embodiments, an adhesive film such as an optically clear adhesive (OCA) or an optically clear resin (OCR) may be included in the antenna dielectric layer 110. In some embodiments, the antenna dielectric layer 110 may include an inorganic insulating material such as silicon oxide, silicon nitride, silicon oxynitride, glass, or the like.

In some embodiments, a dielectric constant of the antenna dielectric layer 110 may be adjusted in a range from about 1.5 to about 12. When the dielectric constant exceeds about 12, a driving frequency may be excessively decreased, so that driving in a desired high or ultra-high frequency band may not be implemented.

The antenna unit 120 may be formed on a top surface of the antenna dielectric layer 110. For example, a plurality of the antenna units 120 may be arranged in an array form along a width direction of the antenna dielectric layer 110 or the antenna package to form an antenna unit row.

The antenna unit 120 may include a radiator 122 and a transmission line 124. The radiator 122 may have, e.g., a polygonal plate shape, and the transmission line 124 may extend from one side of the radiator 122. The transmission line 124 may be formed as a single member substantially integral with the radiator 122, and may have a width smaller than that of the radiator 122.

The antenna unit 120 may further include a signal pad 126. The signal pad 126 may be connected to one end portion of the transmission line 124. In an embodiment, the signal pad 126 may be formed as a member substantially integral with the transmission line 124, and a terminal end portion of the transmission line 124 may serve as the signal pad 126.

In some embodiments, a ground pad 128 may be disposed around the signal pad 126. For example, a pair of the ground pads 128 may be disposed to face each other with the signal pad 126 interposed therebetween.

For example, the ground pad 128 may be electrically and physically separated from the transmission line 124 around the signal pad 126. The ground pad 128 may serve as a bonding pad that may improve bonding stability with a conductive bonding structure 150.

In exemplary embodiments, the antenna unit 120 or the radiator 122 may provide a signal transmission/reception in a high frequency or ultra-high frequency (e.g., 3G, 4G, 5G or higher) band. In non-limiting examples, a resonance frequency of the antenna unit may be from about 24 GHz to about 45 GHz.

The antenna unit 120 may include silver (Ag), gold (Au), copper (Cu), aluminum (Al), platinum (Pt), palladium (Pd), chromium (Cr), titanium (Ti), tungsten (W), niobium (Nb), tantalum (Ta), vanadium (V), iron (Fe), manganese (Mn), cobalt (Co), nickel (Ni), zinc (Zn), tin (Sn), molybdenum (Mo), calcium (Ca) or an alloy containing at least one of the metals. These may be used alone or in combination thereof.

In an embodiment, the antenna unit 120 may include silver (Ag) or a silver alloy (e.g., silver-palladium-copper (APC)), or copper (Cu) or a copper alloy (e.g., a copper-calcium (CuCa)) to implement a low resistance and a fine line width pattern.

In an embodiment, the antenna unit 120 may include a transparent conductive oxide such as indium tin oxide (ITO), indium zinc oxide (IZO), zinc oxide (ZnOx), indium zinc tin oxide (IZTO), etc.

In some embodiments, the antenna unit 120 may include a stacked structure of a transparent conductive oxide layer and a metal layer. For example, the antenna unit may include a double-layered structure of a transparent conductive oxide layer-metal layer, or a triple-layered structure of a transparent conductive oxide layer-metal layer-transparent conductive oxide layer. In this case, flexible property may be improved by the metal layer, and a signal transmission speed may also be improved by a low resistance of the metal layer. Corrosive resistance and transparency may be improved by the transparent conductive oxide layer.

The antenna unit 120 may include a blackened portion, so that a reflectance at a surface of the antenna unit 120 may be decreased to suppress a visual recognition of the antenna unit due to a light reflectance.

In an embodiment, a surface of the metal layer included in the antenna unit 120 may be converted into a metal oxide or a metal sulfide to form a blackened layer. In an embodiment, a blackened layer such as a black material coating layer or a plating layer may be formed on the antenna unit 120 or the metal layer. The black material or plating layer may include silicon, carbon, copper, molybdenum, tin, chromium, molybdenum, nickel, cobalt, or an oxide, sulfide or alloy containing at least one therefrom.

A composition and a thickness of the blackened layer may be adjusted in consideration of a reflectance reduction effect and an antenna radiation property.

In some embodiments, the radiator 122 and the transmission line 124 may include a mesh-pattern structure to improve transmittance. In this case, a dummy mesh electrode (not illustrated) may be formed around the radiator 122 and the transmission line 124.

The signal pad 126 and the ground pad 128 may have a solid pattern structure formed of the aforementioned metal or alloy in consideration of a feeding resistance reduction and a noise absorption efficiency.

In some embodiments, the antenna ground layer 130 may be formed on a bottom surface of the antenna dielectric layer 110. The antenna ground layer 130 may overlap the radiator 122 of the antenna unit 120 in the thickness direction. A substantially vertical radiating antenna may be implemented by generating an electric field or inductance between the radiator 122 and the antenna ground layer 130.

In an embodiment, the antenna ground layer 130 may entirely cover the radiator 122 in a planar view and may not overlap the pads 126 and 128.

The antenna ground layer 130 may include the aforementioned metal and/or alloy. In some embodiments, the antenna ground layer 130 may be included as an independent component of the antenna element device. In some embodiments, a conductive member of the image display device on which the antenna device 100 is employed may serve as the antenna ground layer 130.

The conductive member may include, e.g., a gate electrode of a thin film transistor (TFT), various wirings such as a scan line or a data line, various electrodes such as a pixel electrode or a common electrode, etc., included in a display panel.

In an embodiment, various structures including a conductive material disposed under the display panel may serve as the antenna ground layer 130. For example, a metallic plate (e.g., a stainless-steel plate such as a SUS plate), a pressure sensor, a fingerprint sensor, an electromagnetic wave shielding layer, a heat dissipation sheet, a digitizer, etc. may serve as the antenna ground layer 130.

Figure 3:
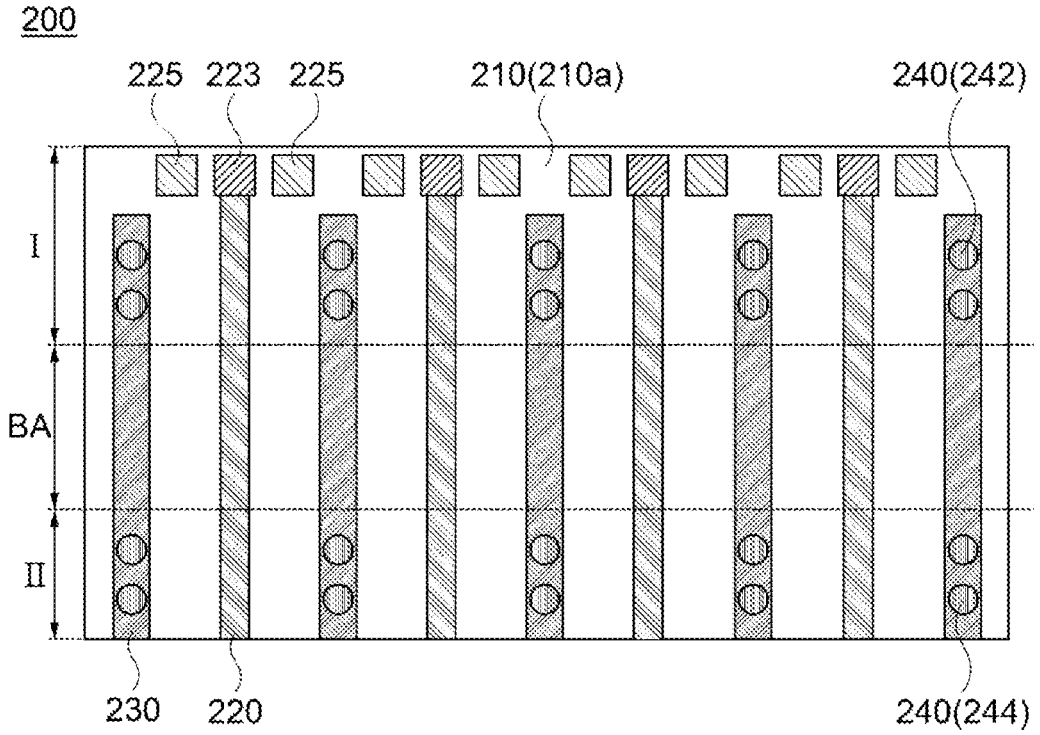
FIG. 3 is a schematic top planar view illustrating a flexible circuit board included in an antenna package in accordance with exemplary embodiments.

FIG. 3 is a schematic top planar view illustrating a flexible circuit board included in an antenna package in accordance with exemplary embodiments.

Referring to FIG. 3, the flexible circuit board 200 may include a bending area BA, a first area I positioned at one end portion of the bending area BA and electrically connected to the above-described antenna unit 120, and a second area II positioned at the other end portion of the bending area BA. For example, the bending area BA may refer to a portion at which the flexible circuit board 200 may be bent.

For example, the first area I may include a region at which the signal pad 126 of the antenna device 100 and the signal wiring 220 of the flexible circuit board 200 may be electrically connected or bonded with each other.

For example, the flexible circuit board 200 and an antenna driving integrated circuit (IC) chip 280 (see FIG. 6) may be electrically connected to each other through a portion of the signal wiring 220 at the second area II.

As described above, the signal wirings 220 may be disposed on the first surface 210*a* of the core layer 210. For example, one end portion of the signal wiring 220 may be bonded to the signal pad 126 of the antenna unit 120 in the first area I, and the other end portion of the signal wiring 220 may be electrically connected to the antenna driving IC chip 280.

For example, the conductive bonding structure 150 (e.g., an anisotropic conductive film (ACF)) may be disposed on the pads 126 and 128 of the antenna unit 120, and a portion of the flexible circuit board 200 in the first area I may be attached on the conductive bonding structure 150. Thereafter, an electrical connection between the signal wiring 220 and the signal pad 126 may be implemented by a bonding process including a heating/pressurizing process.

In exemplary embodiments, a bonding pad 223 may be formed at each terminal end portion of the signal wirings 220. In this case, the bonding pad 223 and the signal pad 126 may be electrically connected to each other. In an embodiment, one end portion of the signal wiring 220 may be directly provided as the bonding pad 223.

In some embodiments, a ground bonding pattern 225 may be further disposed on the core layer 210. For example, the ground bonding pattern 225 may be disposed around the terminal end portion of the signal wiring 220 or the bonding pad 223.

The ground bonding pattern 225 may be aligned over the ground pad 128 of the antenna device 100. The ground bonding pattern 225 may also be electrically connected to the ground pad 128 of the antenna device 100 through the conductive bonding structure 150.

In some embodiments, the signal wirings 220 may extend in a length direction of the flexible circuit board 200 on the first surface 210*a* of the core layer 210 continuously throughout the first area I, the bending area BA and the second area II.

In exemplary embodiments, the ground line 230 adjacent to the signal wiring 220 may be disposed on the first surface 210*a* of the core layer 210. For example, the ground lines 230 may serve as a ground of the signal wirings 220.

In some embodiments, the ground lines 230 extend on the first surface 210*a* of the core layer 210 continuously throughout the first area I, the bending area BA and the second area II.

In exemplary embodiments, the ground layer 250 may be formed on the second surface 210*b* of the core layer 210. For example, an electric field may be generated between the signal wirings 220 and the ground layer 250, so that a feeding efficiency to the antenna unit 120 may be increased. Additionally, the ground layer 250 may be connected to the ground line 230 through a via structure 240, so that signal transmission/reception efficiency through the signal wirings 220 may be improved while shielding noise around the signal wirings 220.

For example, the ground layer 250 may have a solid structure.

In exemplary embodiments, the flexible circuit board 200 may include the via structure 240 connecting the ground line 230 and the ground layer 250.

For example, the via structures 240 may include pillar-shaped or cylindrical-shaped patterns independent from each other, and may penetrate the core layer 210. For example, the via structure 240 may be formed of substantially the same material by the same process for forming the above-described ground line 230.

The via structure 240 may penetrate a portion of the core layer 210 in an area excluding the bending area BA of the core layer 210. In this case, cracks in the via structure that may be caused in the bending area BA when the flexible circuit board 200 is bent may be prevented. Accordingly, a signal loss from the signal wirings may be suppressed and a ratio of the core layer 210 exposed to an outside may be reduced so that driving stability and reliability of the antenna package may be improved.

In some embodiments, the via structure 240 may include a first via structure 242 penetrating a portion of the core layer 210 in the first area I and a second via structure 244 penetrating a portion of the core layer 210 in the second area II.

In this case, the ground layer 250 and the ground line 230 may be connected by the via structures 240 in the first area I and the second area II while preventing the signal loss due to damages to the via structure 240 in the bending area BA. Thus, the signal transmission/reception efficiency and the noise shielding may be effectively implemented.

In some embodiments, a plurality of the signal wirings 220 and a plurality of the ground lines 230 may be alternately and repeatedly arranged on the first surface 210*a* of the core layer 210 to be parallel to each other. Accordingly, the ground lines 230 may serve as a ground barrier of the signal wirings 220.

In an embodiment, a plurality of the via structures 240 may be arranged along an extension direction of each of the ground lines 230 to form a plurality of via columns. For example, a pair of the via columns may be spaced apart from each other with one signal wiring 220 interposed therebetween. Accordingly, the ground line 230 may stably and uniformly function as a ground pattern of the signal wiring 220.

In some embodiments, a plurality of antenna units 120 may be arranged in a width direction of the antenna device 100. In this case, each of the signal wirings 220 may be electrically connected to the signal pad 126 of the antenna unit 120. Further, the ground lines 230 may each be electrically connected to the ground pad 128. For example, each of the ground lines 230 may be connected to the ground bonding pattern 225, and the ground bonding pattern 225 may be electrically connected to the ground pad 128 of the antenna unit 120 as described above.

In some embodiments, a spacing distance between the signal wiring 220 and the ground line 230 on the first surface 210*a* of the core layer 210 (e.g., a shortest distance between a center line of the signal wiring 220 and a center of the ground lines 230) may be from 50 μm to 500 μm. Within the above range, signal interference and signal loss caused when the ground line 230 and the signal wiring 220 are excessively close to each other may be prevented while enhancing a spatial efficiency of the flexible circuit board 200 and the antenna package.

In some embodiments, a diameter of the via structure 240 may be from 120 μm to 200 μm. Within the above range, a connection between the ground layer 250 and the ground line 230 may be properly implemented to sufficiently provide a ground function of the ground line 230 while enhancing the spatial efficiency of the flexible circuit board 200 and the antenna package.

In exemplary embodiments, the signal wiring 220, the ground line 230 and the ground layer 250 may include the above-described metal and/or alloy. For example, the signal wiring 220 and the ground line 230 may be formed of substantially the same material.

Figure 4:
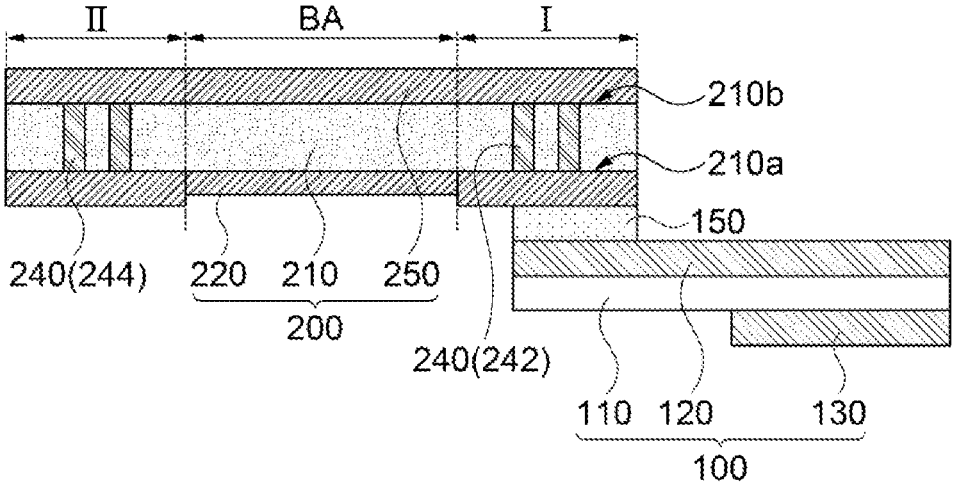
FIG. 4 is a schematic cross-sectional view illustrating an antenna package in accordance with some exemplary embodiments.

FIG. 4 is a schematic cross-sectional view illustrating an antenna package in accordance with some exemplary embodiments.

Referring to FIG. 4, in some embodiments, a thickness of a portion of the signal wiring 220 disposed in the bending area BA of the flexible circuit board 200 may be smaller than a thickness of a portion of the signal wiring in the first area I and/or a second area II.

For example, the via structure 240 is not disposed in the bending area BA, and thus an additional plating process for forming the via structure 240 may be unnecessary. Accordingly, the thickness of the portion of the signal wiring 220 disposed in the bending area BA may be reduced. Thus, an overall thickness of the bending area BA may also be reduced, and bending properties of the flexible circuit board 200 may be improved.

Figure 5:
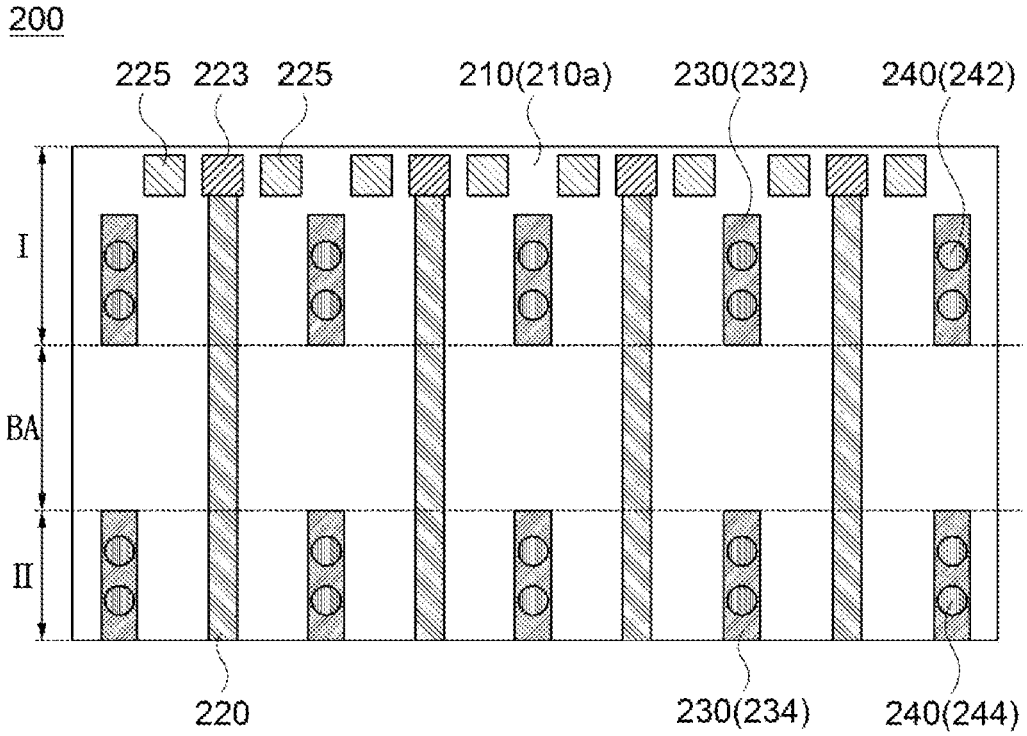
FIG. 5 is a schematic top planar view illustrating a flexible circuit board included in an antenna package in accordance with exemplary embodiments.

FIG. 5 is a schematic top planar view illustrating a flexible circuit board included in an antenna package in accordance with exemplary embodiments.

Referring to FIG. 5, in some embodiments, the ground line 230 may include a first ground pattern 232 formed on a portion of the core layer 210 in the first area I and a second ground pattern 234 formed on a portion of the core layer 210 in the second area II. The first ground pattern 232 and the second ground pattern 234 may be spaced apart from each other with the bending area BA interposed therebetween.

In this case, signal disturbance and signal loss due to damages of the ground line 230 in the bending area BA while the flexible circuit board is bent may be prevented. Accordingly, improved driving stability and signal transmission/reception efficiency of the antenna package may be achieved.

In some embodiments, the first via structure 242 may connect the first ground pattern 232 and the ground layer 250 with each other, and the second via structure 244 may connect the second ground pattern 234 and the ground layer 250. Accordingly, signal disturbance and signal loss of the signal wiring 220 may be prevented while preventing damages of the ground line 230 and the via structure 240 in the bending area BA.

In some embodiments, a conductive layer except for the signal wiring may not be present on a portion of the first surface 210*a* of the core layer 210 in the bending area BA. In this case, the conductive layer that may require an additional plating process other than the signal wiring 220 may not be present, so that the thickness of the signal wiring 220 may be reduced within a range not degrading the signal transmission efficiency. Accordingly, the bending properties of the flexible circuit board 200 may be improved.

Figure 6:
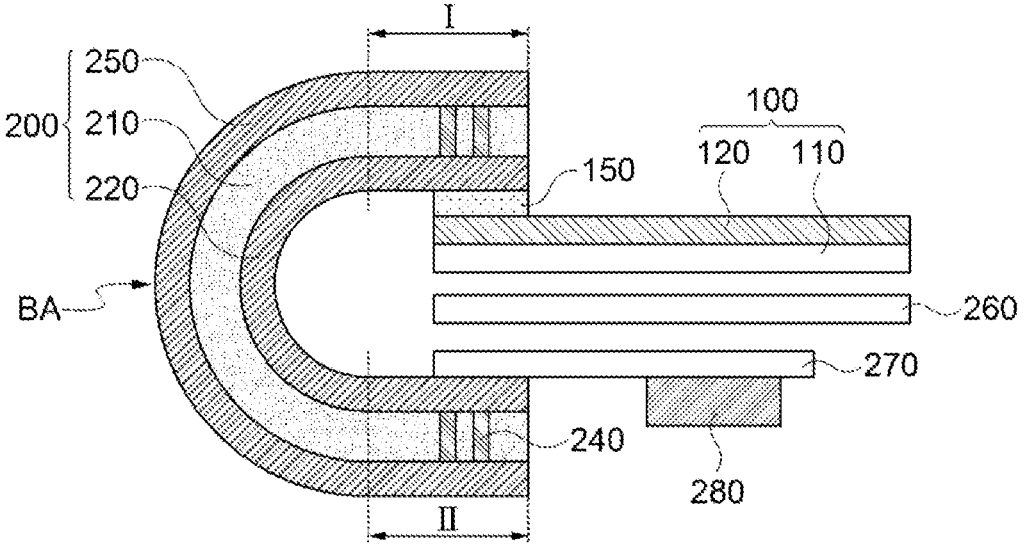
FIG. 6 is a schematic cross-sectional view illustrating an image display device including an antenna package in accordance with exemplary embodiments.

FIG. 6 is a schematic cross-sectional view illustrating an image display device including an antenna package in accordance with exemplary embodiments.

Referring to FIG. 6, an image display apparatus may include a display panel 260 and the antenna package according to the above-described exemplary embodiments. disposed on the display panel 260.

The display panel 260 may include, e.g., an OLED panel or an LCD panel, preferably the OLED panel. The antenna device 100 may be disposed on the display panel 260. The radiator 122 of the antenna unit 120 may be disposed on a display area of the image display device or the display panel 260. In this case, the radiator 122 may include a mesh structure to increase a transmittance and suppress a visual recognition of the antenna unit 120.

The signal pad 126 of the antenna unit 120 may be disposed on a bezel area or a peripheral area of the image display device or the display panel 260. The flexible circuit board 200 may be bonded to the signal pad 126 using the first area I, and may be bent downwardly to the display panel 260 using the bending area BA.

For example, a boundary between the bending area BA and the first area I may be defined as a bending initiation line of the flexible circuit board 200, and a boundary between the bending area BA and the second area II may be defined as a bending terminal line of the flexible circuit board 200 ends.

As illustrated in FIG. 6, the via structure 240 may be formed only in the first area I and the second area II excluding the bending area BA, so that cracks of the via structure 240 and/or the ground line 230 in the bending area BA while bending the flexible circuit board 200 may be prevented.

As described above, the signal wirings 220 having a relatively thin thickness may be included in the bending area BA, and the flexible circuit board 200 may provide improved bending stability. Further, the via structure 240 may not disposed in the bending area BA, so that signal loss and deterioration of driving stability due to cracks in the via structure 240 may be prevented. The second area II may be inserted to a rear portion under the display panel 260 by the bending area BA.

The signal wiring 220 included in the second area II may be electrically connected to the antenna driving IC chip 280 using an intermediate circuit board 270. The intermediate circuit board 270 may include, e.g., a main board, a package board or a rigid printed circuit board.

The antenna driving IC chip 280 may be mounted on the intermediate circuit board 270 to supply a power to the antenna unit pattern 120 through the flexible circuit board 200 and control an antenna radiation.

What is claimed is:

1. An antenna package, comprising:

an antenna device comprising an antenna unit; and a flexible circuit board electrically connected to the antenna unit, the flexible circuit board having a bending area, the flexible circuit board comprising:

a core layer having a first surface and a second surface facing each other;

a signal wiring disposed on the first surface of the core layer and electrically connected to the antenna unit;

a ground line disposed on the first surface of the core layer to be spaced apart from the signal wiring;

a ground layer disposed on the second surface of the core layer; and a via structure penetrating a portion of the core layer in a region excluding the bending area and connecting the ground line and the ground layer with each other, wherein the flexible circuit board further comprises a first area located at one end portion of the bending area and electrically connected to the antenna unit, and a second area located at the other end portion of the bending area, wherein the ground line extends continuously throughout the first area, the bending area and the second area.

2. The antenna package of claim 1, wherein the via structure comprises a first via structure penetrating a portion of the core layer in the first area and a second via structure penetrating a portion of the core layer in the second area.

3. The antenna package of claim 1, further comprising an antenna driving integrated circuit chip connected to the flexible circuit board through a portion of the signal wiring in the second area.

4. The antenna package of claim 1, wherein a thickness of a portion of the signal wiring portion in the bending area is smaller than a thickness of a portion of the signal wiring in the first area or the second area.

5. The antenna package of claim 1, wherein the signal wiring and the ground line are alternately and repeatedly arranged on the first surface of the core layer to be parallel with each other.

6. The antenna package of claim 5, wherein the via structure is repeatedly arranged along an extension direction of the ground line to form a plurality of via columns.

7. The antenna package of claim 6, wherein a pair of via columns of the plurality of via columns are spaced apart from each other with the signal line interposed therebetween.

8. The antenna package of claim 5, wherein the antenna unit comprises a radiator, a transmission line extending from the radiator and a signal pad formed at an end portion of the transmission line, and a plurality of the antenna unit is arranged in a width direction.

9. The antenna package of claim 8, wherein the signal wiring is electrically connected to the signal pad included in each of the plurality of the antenna unit.

10. The antenna package of claim 9, wherein the antenna unit further comprises a ground pad disposed around the signal pad and separated from the signal pad and the transmission line; and the ground line is electrically connected to the ground pad.

11. An image display device, comprising:

a display panel; and an antenna package according to claim 1 disposed on the display panel.

12. The image display device of claim 11, further comprising an antenna driving integrated circuit chip disposed under the display panel, wherein the bending area of the flexible circuit board of the antenna package is bent to be electrically connected to the antenna driving integrated circuit chip.

* * * * *